US005973994A

United States Patent [19]

Woodall

[11] Patent Number: 5,973,994

[45] Date of Patent: Oct. 26, 1999

[54] SURFACE LAUNCHED SONOBUOY

[75] Inventor: Robert Woodall, Lynn Haven, Fla.

[73] Assignee: The United States of America as represented by the Secretary of the Navy, Washington, D.C.

[21] Appl. No.: 09/062,887

[22] Filed: Apr. 20, 1998

[51] Int. Cl.[6] ..... H04B 1/59

[52] U.S. Cl. ..... 367/4; 367/3

[58] Field of Search ..... 367/3, 4

[56] References Cited

U.S. PATENT DOCUMENTS

| | | | |
|---|---|---|---|
| 3,444,508 | 5/1969 | Granfors et al. | 367/3 |
| 3,986,159 | 10/1976 | Horn | 367/3 |
| 4,371,957 | 2/1983 | Sandoz et al. | 367/3 |
| 4,993,344 | 2/1991 | Jones | 114/240 R |
| 5,012,717 | 5/1991 | Metersky et al. | 89/1.11 |
| 5,020,032 | 5/1991 | Dale et al. | 367/4 |
| 5,065,370 | 11/1991 | Rizkowski et al. | 367/3 |
| 5,341,718 | 8/1994 | Woodall, Jr. et al. | 89/1.11 |

FOREIGN PATENT DOCUMENTS

| | | | |
|---|---|---|---|
| 1058452 | 2/1967 | United Kingdom | 367/3 |
| 2280750 | 2/1995 | United Kingdom | 367/3 |

*Primary Examiner*—Ian J. Lobo

*Attorney, Agent, or Firm*—Harvey A. Gilbert; Donald G. Peck

[57] ABSTRACT

A sonobuoy device for tracking and targeting submarines. The sonobuoy device comprises a sonobuoy having aft and forward sections interconnected with each other, fin means mounted on the aft section for flight stabilization of the device during travel above water from the platform, separation means responsive to impact of the device with the water upon completion of the travel thereof for separating the sections of the device from each other, payload means within the forward section of the device for listening for an acoustical signal in response to submergence thereof within the water following the separation of the sections of the device, flotation means mounted within the device and inflated in response to the impact with the water for anchoring the payload means and tethering means connecting the flotation means to the payload means for limiting the submergence thereof while anchored by the flotation means to a predetermined depth at which the payload means receives an acoustical signal. An apparatus comprising the device with a launching system and a method for deploying the device also is disclosed.

13 Claims, 5 Drawing Sheets

SURFACE LAUNCHED SONOBUOY

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention generally relates to a device and method for tracking and targeting submarines from a surface ship, surface platform, or land-based platform. More particularly, the device and method enable a surface ship to launch a sonobuoy into navigable waters to locate a submarine. Most particularly, the device and method facilitate immediate submarine tracking and targeting without the need for aircraft support.

2. Description of the Related Art

Sonobuoys are presently available for military air operations tracking and targeting submarines. The expendable acoustic listening devices are deployed into seawater to locate submarines by listening to noises generated by the submarines, such as engine and screw noises, and the like. Some sonobuoys also use active "pinging" and listen for an echo, or return, to locate objects. Once dropped by aircraft, sonobuoys provide data which is used by surface ships to plot submarine locations in an operating area. Sonobuoys can also locate surface vessels at greater than visual range. Surface ships are able to use the plotted information defensively to position themselves against possible submarine attack, or offensively to attack the submarine.

Currently, naval surface ships deploy sonobuoys against submarine targets by launching a ship board helicopter, such as the LAMPS helicopter currently on board many U.S. warships, or by coordinating with helicopters from other naval vessels and with land-based helicopters and airplanes, such as the P-3 Orion. These aircraft fly over an area of a possible submarine location, and then drop sonobuoys into the water. Once in the water, the sonobuoys are activated to listen for submarines, and once a submarine is located, the sonobuoys relay tracking information of the submarine to the surface ship.

The need for surface ships to coordinate the deployment of sonobuoys with aircraft impedes a ship's ability to use the sonobuoys in rapid fashion. Aircraft may require extensive warm-up times which is often excessively time consuming. Additionally, aircraft flight may be difficult or impossible in inclement weather, and hazardous over restricted flight areas, or under hostile and/or wartime conditions. Aircraft may also be unavailable for such a mission when needed.

Launch systems on board surface ships are known in the art. U.S. Pat. No. 5,341,718 (Woodall, Jr. et al.) discloses a torpedo decoy launched from a surface ship. U.S. Pat. No. 4,993,344 (Jones) discloses a shipboard torpedo defense. Sonobuoys are disclosed in U.S. Pat. Nos. 5,065,370 (Rizkowski et al), 5,020,032 (Dale et al.), and 5,012,717 (Metersky, et al.). However none of these patents disclose a ship launched sonobuoy.

It is therefore an object of the present invention to provide for deployment of sonobuoys from naval surface vessels.

In view of the foregoing objective, it is a more particular object of the present invention to provide a transport round for launch of a sonobuoy payload from existing mortar or rocket launchers on naval surface vessels, whereby safe, rapid and effective deployment of a sonobuoy is achieved.

SUMMARY OF THE INVENTION

The present invention provides a sonobuoy device for tracking and targeting naval vessels, the sonobuoy device comprising a sonobuoy and having aft and forward sections interconnected with each other, fin means mounted on the aft section for flight stabilization of the device during travel above water from the surface platform, separation means responsive to impact of the device with the water upon completion of the travel thereof for separating the sections of the device from each other, payload means within the forward section of the device for listening for an acoustical signal in response to submergence thereof within the water following the separation of the sections of the device, flotation means mounted within the device and inflated in response to impact with the water for anchoring the payload means and tethering means connecting the flotation means to the payload means for limiting the submergence thereof while anchored by the flotation means to a predetermined depth at which the payload means receives an acoustical signal.

Additionally, an apparatus for tracking and targeting naval vessels, mountable on a surface platform, comprising a launching system and the above-described sonobuoy device positioned within the system is disclosed. In accordance with the present invention, the sonobuoy device is ejected from a launcher for travel through the air to a location at which it impacts with the water surface. The sonobuoy device includes a sonobuoy and aft and forward sections that are separable upon water surface impact. A listening payload carried within the forward section of the device is thereby displaced from its enclosure and sinks to a depth at which it may passively or actively, through sonobuoy or ship sonar ping, acquire acoustical signals. The payload is tethered to a flotation anchor inflated and released from a separated section of the sonobuoy at the water surface impact location.

The aft section of the device is provided with fins projected therefrom upon exit of the device from the launching tube to stabilize flight before impact. Safety arming means within the aft section is also rendered operative upon launch of the device to enable subsequent separation of its sections and impact responsive inflation of the flotation anchor by explosive charges carried by the device. Also, the safety means maintains the explosives within the device out of line for safe handling prior to launch.

A method for tracking and targeting naval vessels from a surface platform using the previously discussed apparatus comprising the steps of providing the apparatus, propelling the device from the surface platform into the water, and receiving tracking data from the sonobuoy, wherein the data permits localization of the naval vessel also is disclosed.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF DRAWINGS

In the following detailed description, reference will be made to the attached drawings in which.

DETAILED DESCRIPTION OF THE PREFERRED EMBODIMENT

The present invention is a device, apparatus and method for tracking and targeting submarines without air support. Sonobuoy devices are launched directly from a surface platform, such as a naval surface vessel, fixed platform or land, into an area where a submarine is possibly located. The sonobuoy passively or actively listens for noise from the submarine, and once a noise signal is acquired, transmits location data of the submarine to the surface vessel.

Figure 1:
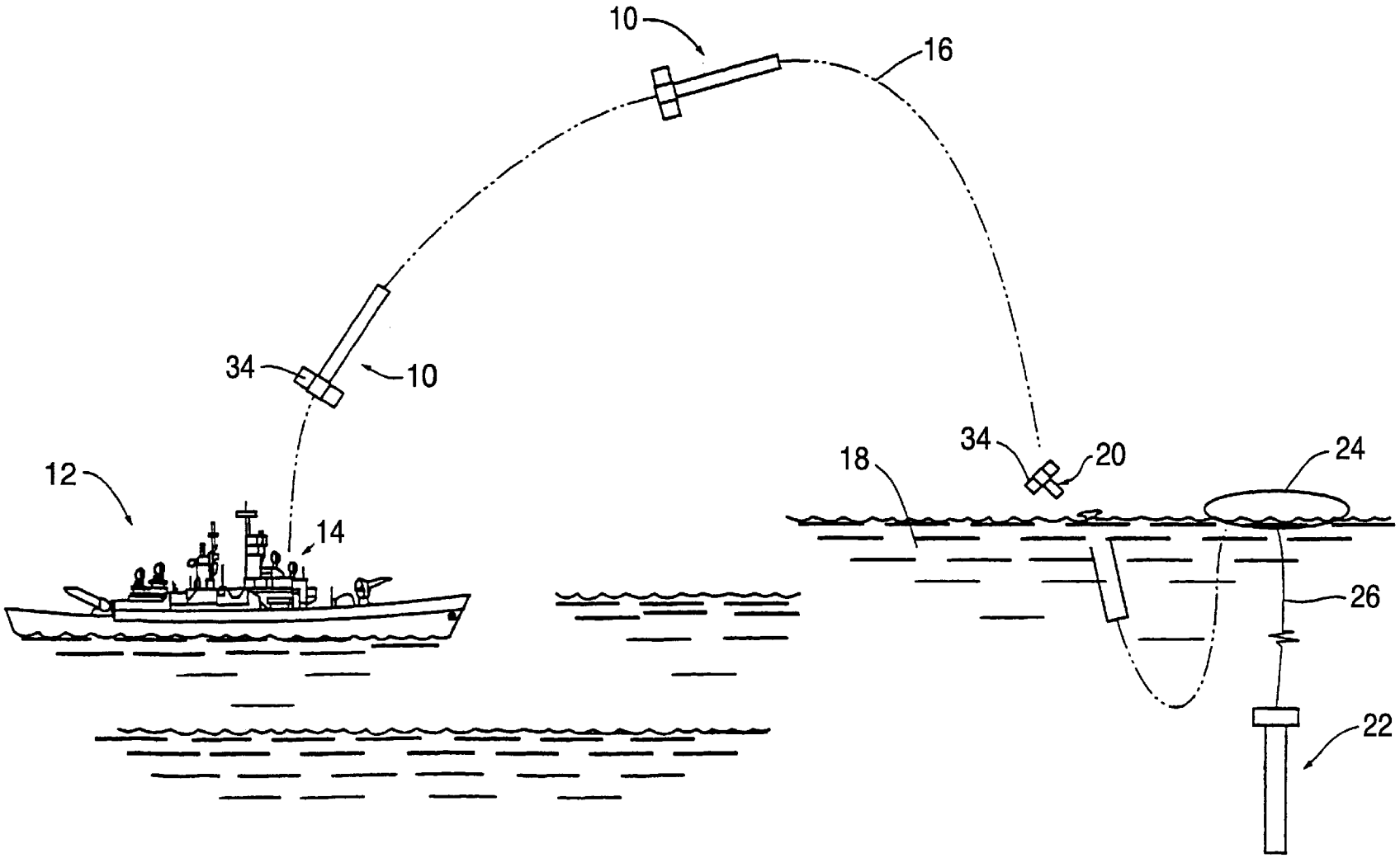
FIG. 1 is a side elevation view illustrating deployment of a sonobuoy in accordance with the preferred embodiment of the present invention.

As illustrated in the drawings, FIG. 1 illustrates the deployment of a sonobuoy device 10 launched from a naval surface vessel 12 by a launching system 14, which may be mortar, rocket, or other like launch systems known in the art. Most preferably, the launching system 14 is a MK137 Decoy Launcher. In the preferred embodiment of the invention, the sonobuoy device 10 is placed into a suspected area of submarine activity within navigable waters. The sonobuoy device 10, once launched, travels along a trajectory 16 through the air for sufficient distance from the vessel 12 to arrive within the area of submarine activity. This area of submarine activity is of such size as to enable a sonobuoy to passively or actively detect the submarine, and varies according to submarine noise, sonobuoy sensitivity, and other factors known in the art. The sonobuoy device 10 travels from the vessel 12 to impact on the water surface 18 causing the aft end section 20 of the sonobuoy device 10 to separate. Separation of device sections occurs as a result of impact which also releases the sonobuoy 22, which is generally of a type currently in use in the fleet. The sonobuoy 22 is expendable, but may be recovered. A flotation anchor 24 also is deployed. The sonobuoy 22 remains connected to the flotation anchor 24 by a tether cord 26, and sinks to a depth predetermined by the length of the tether cord 26. Upon reaching such tethered depth, the submerged sonobuoy 22 is buoyed in the water while passively listening for a submarine within the area. Once the submarine is detected, sonobuoy 22 transmits submarine locating data back to the naval vessel.

Figure 2:
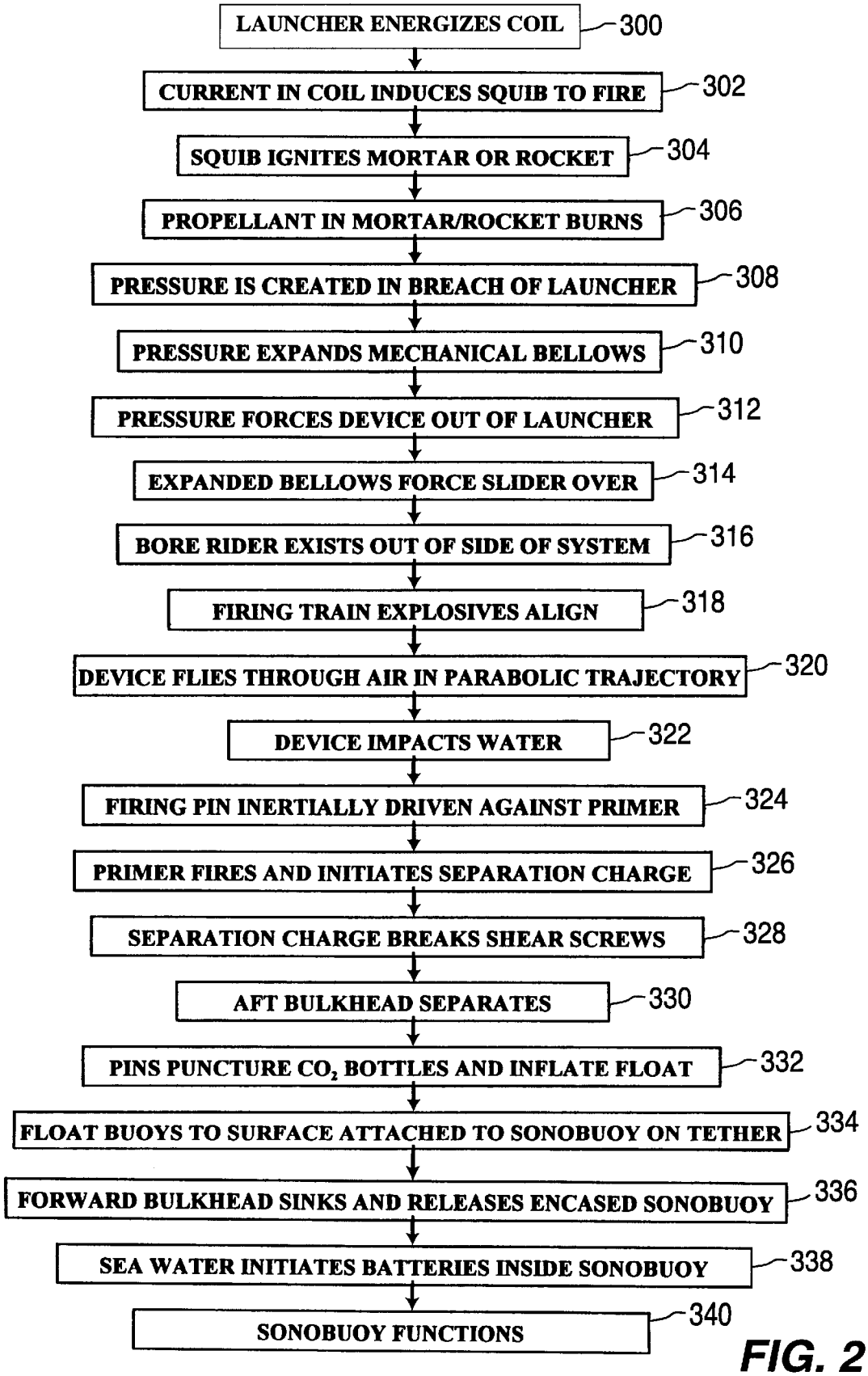
FIG. 2 is a functional flow diagram of the deployment associated with the present invention.

With further reference to the drawings, FIG. 2 diagrams the operational deployment in the launching associated with the sonobuoy device 10. The deployment is initiated when the launcher energizes the coil 300. Current in the coil induces a squib to fire 302, which ignites the mortar or rocket 304. As the propellant in the mortar or rocket burns 306, pressure is created in the breech of the launcher 308. Pressure expands a mechanical bellows 310, and forces the sonobuoy device 10 up and out of the launcher 312. At the launcher exit, or barrel, the expanded bellows forces the slider over 314, the bore rider exits the side of the round 316, allowing the firing train explosives to align 318. The sonobuoy device 10 flies through the air 320 and over the water, on a parabolic trajectory 16 (FIG. 1) and impacts the water surface 18. On water impact 322, the firing pin is inertially driven against a primer 324, which fires and initiates the separation charge 326. The separation charge produces pressure internal to the sonobuoy device 10 sufficient to break the shear screws 328 securing the aft bulkhead to the round (sonobuoy). The aft bulkhead separates 330 from the round, and $CO_2$ bottles punctured by pins as the separation charge functions, inflate 332 the floatation anchor 24. The floatation anchor 24 buoys 334 to the water surface 18 anchored to the sonobuoy payload. The heavy forward bulkhead sinks into the sea to release 336 the encased sonobuoy 22. Seawater initiates the batteries inside 338 the sonobuoy 22, thereby activating the sonobuoy 22 to function 340.

Figure 3:
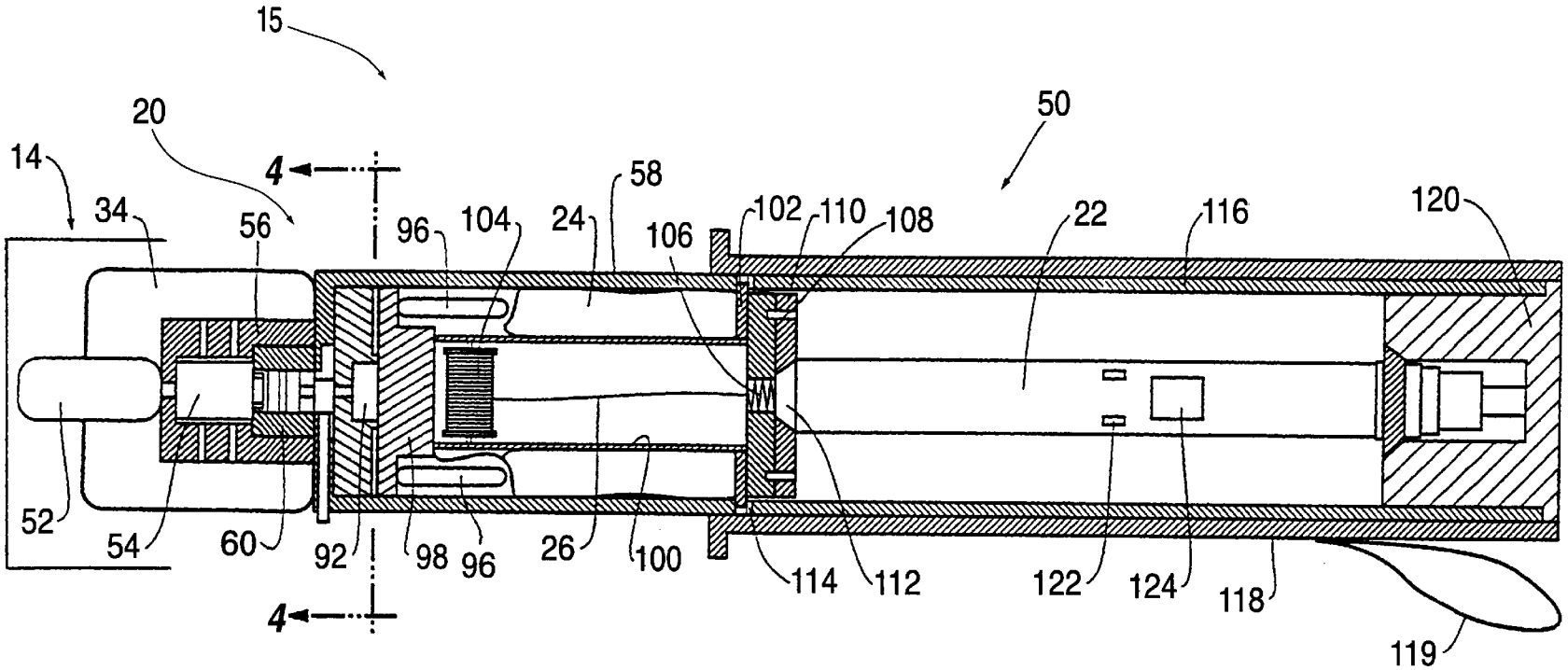
FIG. 3 is a side section view through a sonobuoy device of the present invention as shown in FIG. 1, prior to launch.
Figure 5:
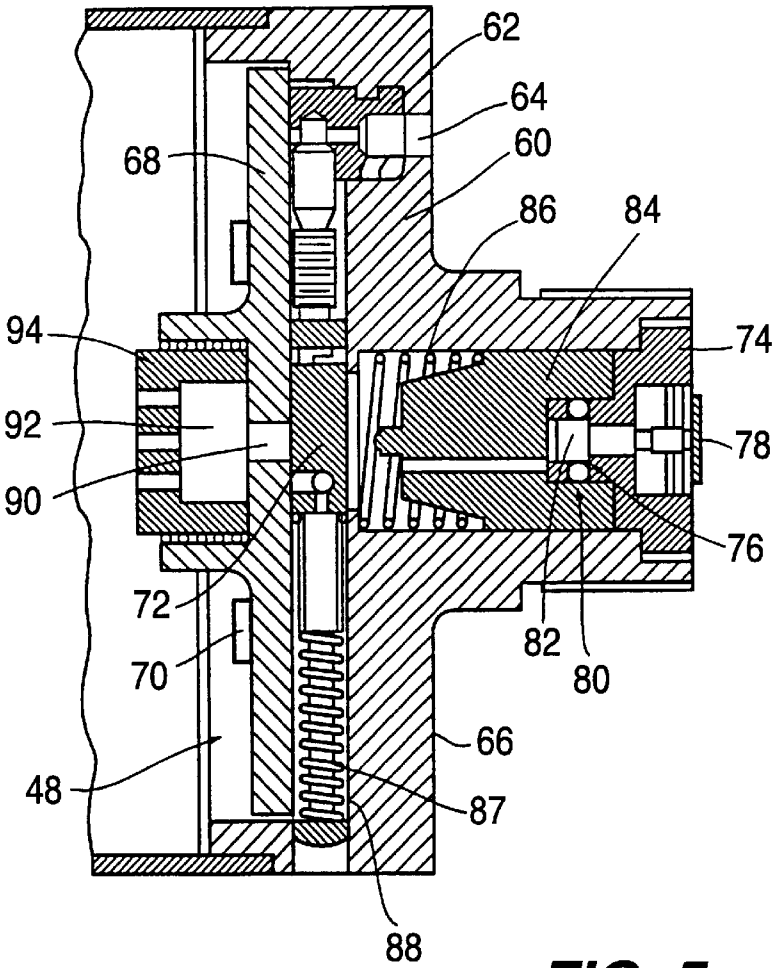
FIG. 5 is a partial section view taken substantially through a plane indicated by section line 5—5 in FIG. 4; and, FIG. 6 is a side view of a deployed sonobuoy.
Figure 4:
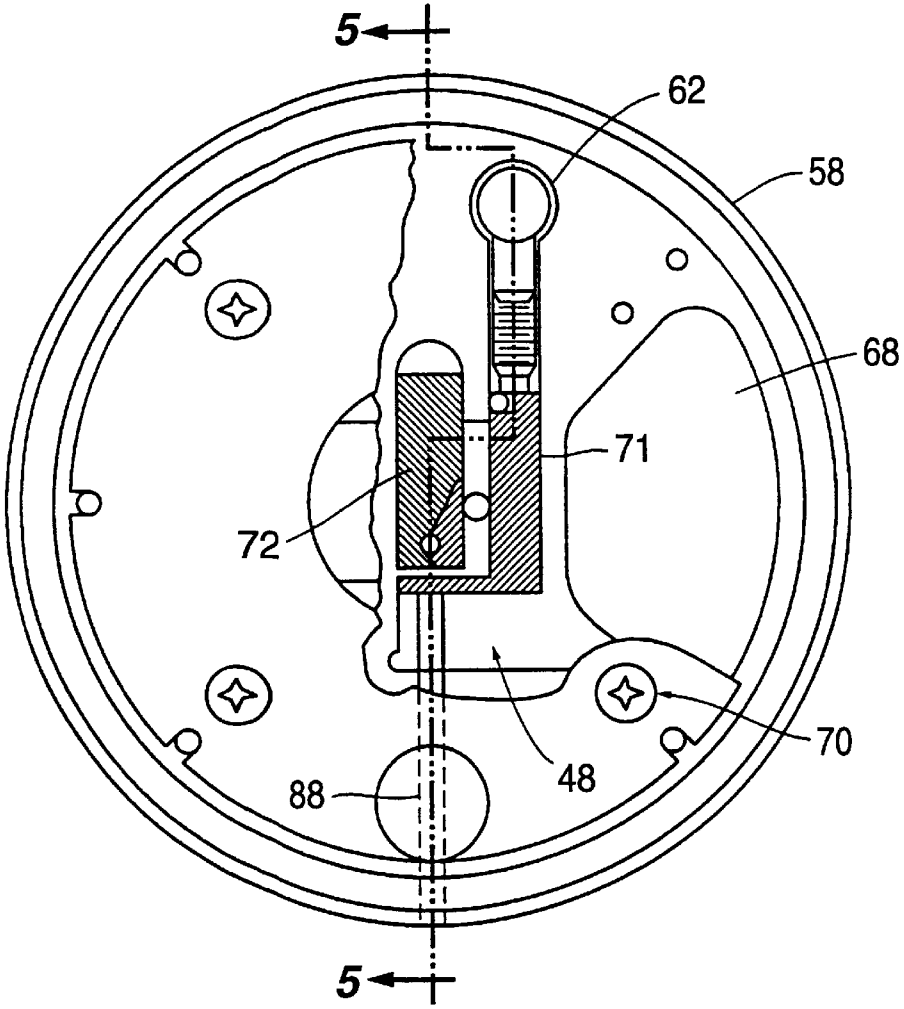
FIG. 4 is an enlarged transverse section view taken substantially through a plane indicated by section line 4—4 in FIG. 3.

The sonobuoy device 10, before launch, is shown in greater detail in FIGS. 3, 4, and 5. The sonobuoy device 10, when placed within a launching system 14, forms an apparatus 15. The sonobuoy device 10 comprises separable enclosure sections as depicted in FIG. 3 including the aforementioned aft end section 20 and forward section 50. The aft end section 20 encloses the aforementioned flotation anchor 24 seen in FIG. 3 and separation mechanism 48 shown in FIGS. 4 and 5. The forward section 50 encloses the aforementioned sonobuoy 22. Upon launch, the fins 34 are extended or projected from the aft end section 20 as aforementioned to stabilize flight of the sonobuoy device 10 along its trajectory 16. The separation mechanism 48 (shown in FIGS. 4 and 5) is also armed during launch in preparation for completed deployment of the sonobuoy device 10 following its impact with the water surface, as explained in detail hereinafter.

With reference to FIGS. 3 and 5, the aft end section 20 of the sonobuoy device 10 includes a rearwardly projecting firing coil 52 located centrally within the assembly of fins 34. The launcher begins operation in a well known mortar launching manner by energizing the coil 52 so as to forwardly fire a squib therefrom into a propellant charge 54 enclosed within a support housing 56 carrying the fins 34 attached to a small diameter holder extension 60 of a tubular housing 58 of the aft end section 20. The resulting ignition of the propellant charge 54 exerts a forward thrust on the tubular housing 58 through its holder extension 60 to which the support housing 56, enclosing the propellant charge 54, is threadedly connected. Expansion of gases from the ignited propellant charge inside of the launcher exerts pressure on the sonobuoy device 10 to exert forward propelling thrust thereon.

As particularly shown in FIGS. 4 and 5, the separation mechanism 48 includes a bellows assembly 62 which is extended radially inwardly of the holder extension 60 by the propellant gas pressure entering opening 64 therein on rear end face 66, opposite a plate 68 mounted on the holder extension by a plurality of screw fasteners 70. A cocking bar 71 is thereby displaced by the bellows assembly to release a slider 72 from plate 68 in preparation for subsequent arming of the payload. Propellant gas pressure is also exerted on an arming disk 74 slidably mounting a piston 76, having a shield disk 78 at its rear end. The arming disk 74 and piston 76 are disposed within the holder extension 60 at its forward end. Locking ball bearing elements 80 in engagement with the inner end portion 82 of the piston 76 hold the arming disk axially fixed to an inertial firing pin 84 slidably mounted in the holder extension 60 under the bias of an anti-creep spring 86. Thus, inward displacement of the piston 76 by the propellant gas pressure, as aforementioned, releases the firing pin 84 from the arming disk 74 for subsequent axial displacement relative to the holder extension 60. When the sonobuoy device 10 emerges from the barrel of the launching system 14, a rider 87 is free to be displaced radially outward from a bore 88 in the holder extension 60 to complete arming of the payload by displacement of slider 72, while the fins 34 are forced open by the sudden pressure differential at the launching barrel exit.

As the sonobuoy device 10 impacts with the surface of the water, the firing pin 84 is thrust forwardly against the bias of spring 86 into the space opened by displacement of the slider 72 to expose a stab primer 90 in the plate 68. In response to the firing pin 84 striking the primer 90, a separation charge 92 within retainer 94 threadedly mounted on the forward face of the plate 68, is fired. The pressure generated by firing of charge 92 separates the aft section 20 and punctures either one or two bottles 96 of pressurized $CO_2$ gas positioned within the tubular housing 58 by rear end wall support 98 located forwardly of the deflated anchor floats 24, as shown in FIG. 3. The anchor floats and gas bottles 96 are furthermore positioned about a tubular support sleeve 100 fixed to end wall support 102 of the sonobuoy device 10. The sleeve 100 extends axially from end wall support 102 into abutment with the opposite end wall support 98 and rotatably mounts therein a tether spool 104 in spaced adjacency to end wall support 98. The tether cord 26 extends from spool 104 through the end wall support 102 for connection to the rear end of the sonobuoy 22 within the forward end section 50 of the sonobuoy device 10 as shown in FIG. 3.

As further seen with continued reference to FIG. 3, the rear end of sonobuoy 22 abuts the end wall support 102 and is held in coaxial alignment therewith by rubber supports 108 projecting into the end wall support from a support disc 110 having a conical opening within which the rear end portion 112 of the payload is seated. The support disc 110 is axially positioned within a sleeve 116 protectively enclosing the sonobuoy 22 within the forward end section 50, to which the end wall support 102 is connected by shear screws 114. An outer extender tube 118 having a handle 119 attached thereto is clamped to the launcher and remains attached thereto during launch so as to enclose the sleeve 116 and project axially therebeyond over the tubular housing 58 of the sonobuoy device 10 prior to launch. An end support body 120 at the forward end holds the protective sleeve 116 assembled to the sonobuoy device 10, as shown, prior to water impact.

After the impact of the sonobuoy device 10 with the surface of the water, the screws 114 are sheared by the aforementioned generation of pressure in response to firing of the separation charge 92 to separate the forward section 50 from the sonobuoy device 10. Upon separation of the forward section 50, the expansion of gas from the punctured bottles 96 inflates the anchor floats 24 which are thereby buoyed to the water surface as diagramed in FIG. 1. The separated forward section 50 then sinks as the tether spool 104 pays out the tether cord 26 with the sonobuoy 22 being impelled for displacement forwardly from its enclosing sleeve 116 by the thrust of separation spring 106 shown in FIG. 3. With the sonobuoy 22 submerged, the seawater under pressure enters inlets 122 in order to activate the payload by wetting of its seawater battery 124. Accordingly, when the payload reaches its tethered depth, a hydrostatic seawater pressure switch enables the payload to begin monitoring the area for the presence of submarines.

Figure 6:
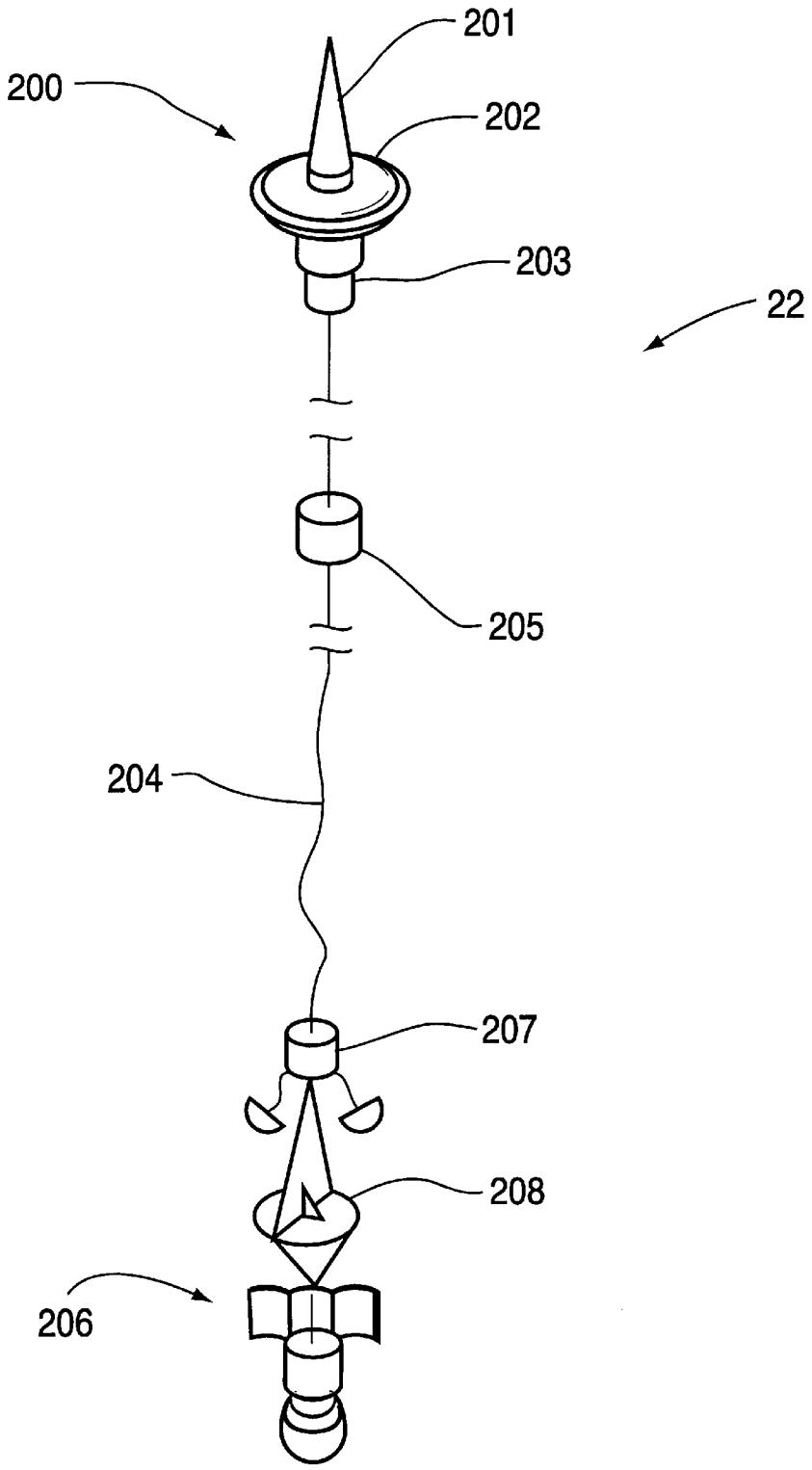

FIG. 6 shows a deployed sonobuoy 22 once it has entered into the water. A head portion 200 comprises an antenna 201 and float 202, which support a surface electronics package 203 beneath the water's surface. Cable 204 extends from cable housing 205 which connects to a listening device section 206. Along the cable 204, a drogue 207, drogue damper 207, or damper disc may be placed. The listening device section 206 includes a hydrophone and lower electronics. The sonobuoy 22 also includes a battery 124, which may be silver chloride, lead chloride and the like, which is known to those skilled in the art.

Operationally, the method for tracking and targeting naval vessels, such as submarines, from a surface platform using the described apparatus requires that the data received by the sonobuoy and transmitted to the surface platform be analyzed in order to localize a detected submarine. Continuous data permits the continued localization and tracking of the submarine. With additional launches of sonobuoys, increasing amounts of data are provided to the surface platform vessel, giving redundancy, which increases the reliability of continued contact with the submarine. This redundancy also permits continued launching of additional sonobuoys close to the submarine, thereby ensuring more continuous data. The surface platform monitors the movement of the submarine to defensively encounter any hostile acts by the submarine. Continuous data collection and analysis further permits the surface platform to target the submarine, should the need arise. Multiple sonobuoys may be launched to straddle the location of the submarine or to form a network of sonobuoys in the area of submarine activity.

While there have been described what are presently believed to be the preferred embodiments of the invention, those skilled in the art will realize that changes and modifications may be made thereto without departing from the spirit of the invention. It is intended that the claims attached hereto include all such changes and modifications that fall within the true scope of the invention.

What is claimed is:

1. An apparatus for tracking and targeting naval vessels, mountable on a surface platform, said apparatus comprising:

a launching system;

a sonobuoy device positioned within said system, said device comprising:

a sonobuoy having aft and forward sections interconnected with each other;

fin means mounted on the aft section for flight stabilization of said device during travel above water from a surface platform;

separation means responsive to impact of said device with the water upon completion of the travel thereof for separating the sections of said device from each other;

payload means within the forward section of said device for listening for an acoustical signal in response to submergence thereof within the water following said separation of the sections of said device;

flotation means mounted within said device and inflated in response to impact with the water for anchoring the payload means and tethering means connecting the flotation means to the payload means for limiting said submergence thereof while anchored by the flotation means to a predetermined depth at which the payload means receives an acoustical signal, wherein said launching system is capable of propelling said device from the surface platform into the water.

2. The device of claim 1, further comprising safety arming means within said enclosure means for enabling said explosive means and said flotation anchoring means in response to launch.

3. The apparatus of claim 1, wherein said apparatus further includes a rocket motor for propelling said device.

4. The apparatus of claim 1, wherein said apparatus further includes a mortar for propelling said device.

5. The apparatus of claim 1, wherein the surface platform is a ship.

6. A method for tracking and targeting naval vessels from a surface platform, comprising the steps of:

(a) providing an apparatus mountable on the surface platform, said apparatus comprising a launching system and a sonobuoy device positioned within said system, said device comprising a sonobuoy and having aft and forward sections interconnected with each other, fin means mounted on the aft section for flight stabilization of said device during travel above water from the surface platform, separation means responsive to impact of said device with the water upon completion of the travel thereof for separating the sections of said device from each other, payload means within the forward section of said device for listening for an acoustical signal in response to submergence thereof within the water following said separation of the sections of said device, flotation means mounted within said device and inflated in response to impact with the water for anchoring the payload means and tethering means connecting the flotation means to the payload means for limiting said submergence thereof while anchored by the flotation means to a predetermined depth at which the payload means receives an acoustical signal, wherein said launching system is capable of propelling said device from the surface platform into the water;

(b) propelling said device from the surface platform; and, (c) receiving tracking data from said sonobuoy, wherein said data permits localization of the naval vessel.

7. The method of claim 6, wherein the naval vessel is a submarine.

8. The method of claim 7, further comprising the step of locating the submarine with data from said sonobuoy.

9. The method of claim 7, further comprising the step of tracking the submarine with additional data from said sonobuoy.

10. The method of claim 8, wherein said additional devices are propelled from the surface platform to straddle additional sonobuoys in relation to the location of the submarine.

11. The method of claim 8, further comprising the step of propelling additional devices from the surface platform, thereby locating additional sonobuoys in the water proximate to the location of the submarine and continuously maintaining data on the location of the submarine.

12. The method of claim 11, wherein said additional sonobuoys form a network of sonobuoys.

13. The method of claim 8, further comprising the step of targeting said submarine with said data from said sonobuoy.

* * * * *